US007832136B2

(12) United States Patent
Rush

(10) Patent No.: US 7,832,136 B2
(45) Date of Patent: Nov. 16, 2010

(54) SAFETY DEVICES FOR FIREARMS

(76) Inventor: Derek Rush, 6031 Winged Foot Dr., Gilroy, CA (US) 95020

( * ) Notice: Subject to any disclaimer, the term of this patent is extended or adjusted under 35 U.S.C. 154(b) by 27 days.

(21) Appl. No.: 12/163,998

(22) Filed: Jun. 27, 2008

(65) Prior Publication Data

US 2009/0071054 A1 Mar. 19, 2009

Related U.S. Application Data

(60) Provisional application No. 60/937,586, filed on Jun. 27, 2007.

(51) Int. Cl.
*F41A 17/00* (2006.01)

(52) U.S. Cl. ..... 42/70.11; 42/66

(58) Field of Classification Search ..... 42/70.11, 42/66, 67, 70.01, 95; 102/529, 442
See application file for complete search history.

(56) References Cited

U.S. PATENT DOCUMENTS 3,708,901 A * 1/1973 Wolter ..... 42/70.11
4,224,753 A * 9/1980 Bielman ..... 42/70.11
5,491,918 A * 2/1996 Elmstedt ..... 42/70.11
6,708,438 B1 * 3/2004 Sorensen ..... 42/96
2002/0112389 A1 * 8/2002 Kellerman ..... 42/70.11
2002/0121039 A1 * 9/2002 Kellerman ..... 42/70.11
2003/0221351 A1 * 12/2003 Barber et al. ..... 42/70.11

* cited by examiner

*Primary Examiner*—Michelle Clement
(74) *Attorney, Agent, or Firm*—Gregory & Martensen LLP

(57) ABSTRACT

Firearm safety devices are described that enable the safe operation, training, storage, display, and transportation of firearms. The firearm safety devices, referred to herein as "safety casing" devices, are configured for easy insertion and removal from a firearm without risk of damage to the firearm. The safety casing devices clearly indicate to those handling and observing the host firearm that the firearm chamber is free or devoid of a live round and thus safe because the firearm cannot be fired. The safety casing devices permit the firearm to be used in training exercises, including dry fire practice, while preventing accidental discharge.

16 Claims, 2 Drawing Sheets

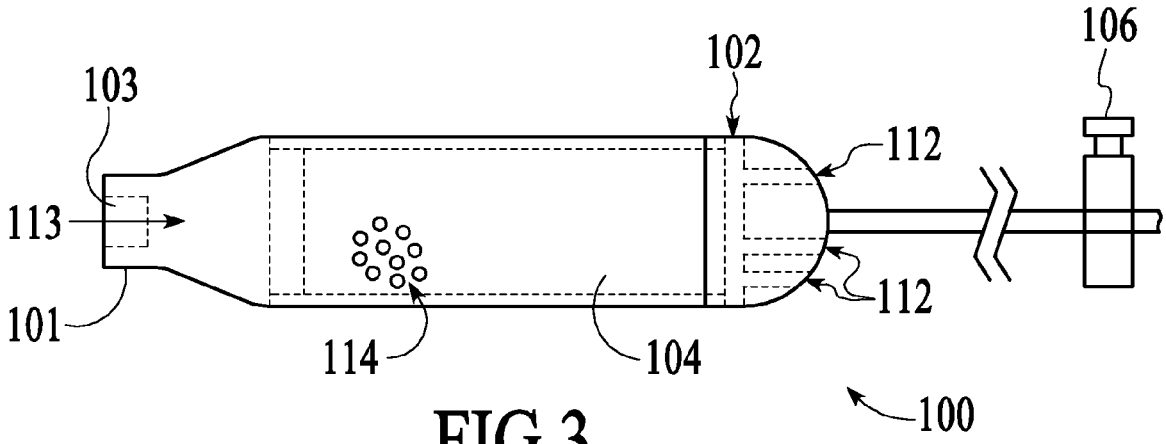
FIG.3
FIG.3A
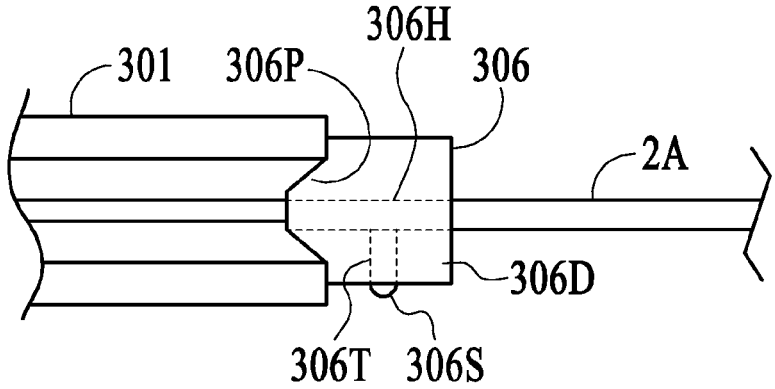
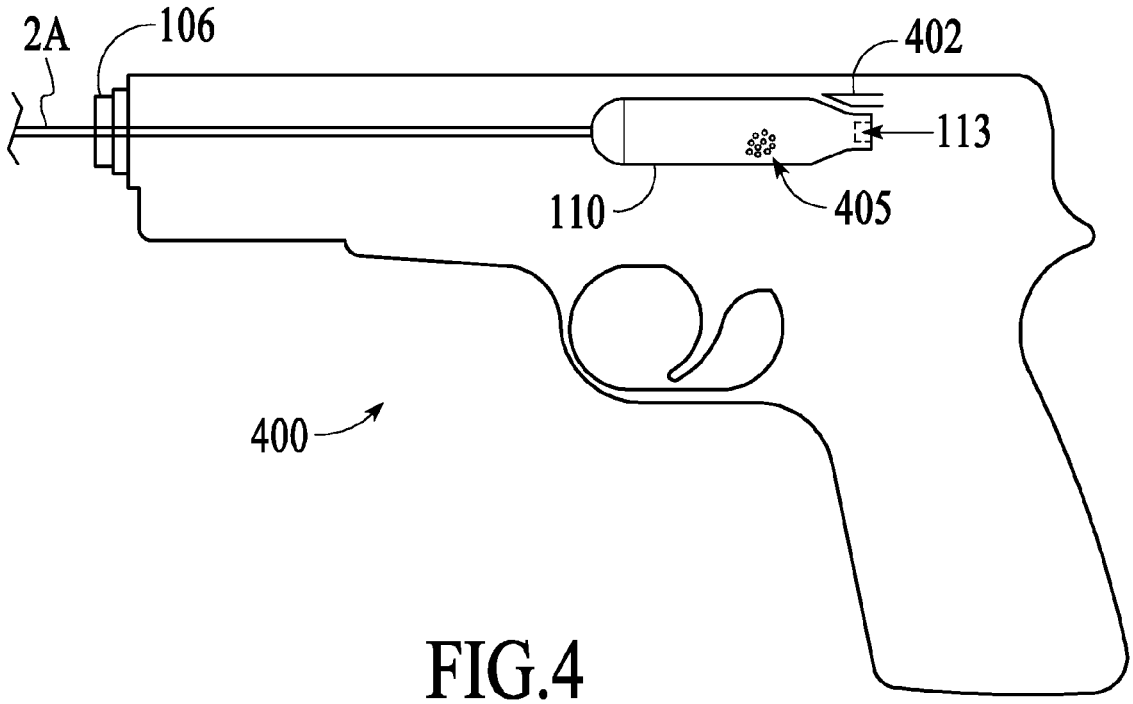
FIG.4

SAFETY DEVICES FOR FIREARMS

RELATED APPLICATION

This application claims the benefit of U.S. Patent Application No. 60/937,586, filed Jun. 27, 2007.

TECHNICAL FIELD

Embodiments herein relate to firearm safety devices and, more particularly, to devices used in a firearm to permit the firearm to be used in training exercises (e.g., dry fire practice) while preventing accidental discharge and clearly indicating to the user and others that the firearm chamber is free of a live round and thus safe.

BACKGROUND

The training of persons to safely use firearms in confrontational situations requires actual firing time on a firing range, as well as exercises in which unloaded firearms are used to demonstrate various defensive actions. Range officers who conduct such training must carefully scrutinize each trainee's performance, so as to make certain the trainee learns the safe handling of loaded firearms. These exercises typically involve live firing of the firearm under supervision.

In other exercises carried out by the trainee, the firearm is operated in an unloaded condition, and dry fired, or fired without ammunition. A source of accidents results from accidental discharges, which occur when training switches from a live fire session to a dry fire practice session. The problem of making certain that all firearms are properly unloaded during dry fire practice is aggravated by the fact that an empty firearm with a closed chamber is usually indistinguishable from one in which a cartridge has been loaded and is ready to fire. For this reason, accidental discharges occur at an unfortunately alarming rate.

Various devices have been proposed for disabling the firearm for safe practice and carriage. These devices typically fit within the firing chamber, and obstruct any introduction of a round into the firing chamber. These conventional devices, however, are configured in such a manner as to be difficult to insert and/or remove from the firearm without risking damage to the firearm during the insertion and/or removal. Similarly, these conventional devices are configured such that their continual use during dry fire practice results in damage to components of the firearm (e.g., ejector, firing pin, etc.).

Associated with the problem of making sure that a live round is not introduced into the chamber during dry fire practice is a problem of determining from casual observation whether or not firearm has been disabled. Since the slide is closed and/or the bolt is in battery position during dry fire practice, external viewing of the disabled firearm by an observer does not disclose whether or not the firearm is in fact disabled.

Consequently, there is a need for a firearm safety device that clearly indicates to the user and/or observers with certainty that the chamber of the firearm is free and clear of a live round so that the user and/or observers can be confident that the firearm is safe and cannot be fired. There is also a need for a firearm safety device that enables the firearm to be dry fired, holstered and cycled in a normal manner to closely simulate actual firearm use for employment in training exercises while not damaging components of the firearm.

INCORPORATION BY REFERENCE

Each publication, patent, and/or patent application mentioned in this specification is herein incorporated by reference in its entirety to the same extent as if each individual publication or patent application was specifically and individually indicated to be incorporated by reference.

BRIEF DESCRIPTION OF THE DRAWINGS

FIG. 3 is a safety casing device configured for moisture control, under an alternative embodiment.

FIG. 3A is a locking device 306, under an alternative embodiment.

FIG. 4 shows a firearm with a safety casing device in the chamber, under an embodiment.

DETAILED DESCRIPTION

Firearm safety devices are described herein that enable the safe operation, training, storage, display, and transportation of firearms. The firearm safety devices, referred to herein as "safety casing" devices, are configured for easy insertion and removal from a firearm without risk of damage to the firearm. The safety casing devices clearly indicate to those handling and observing the host firearm that the firearm chamber is free or devoid of a live round and thus safe because the firearm cannot be fired. The safety casing devices permit the firearm to be used in training exercises (e.g., dry fire practice) while preventing accidental discharge.

The safety casing devices of an embodiment indicate to the user that the firing chamber is devoid of a live round, and they also have the effect of rendering the firearm unusable as well because the firing chamber is completely blocked. While this may be desirable in certain situations (e.g., storage, transportation, display) and for certain users to render the firearm completely unusable, there are other situations where it is desirable for the firearm to continue to operate. The ability to dry fire a firearm while simultaneously knowing, with certainty, that the firearm will not fire an actual round, is critical for use in training exercises, such as for law enforcement personnel, military personnel, and the like. Furthermore, the safety casing devices allow the firearm hosting the device to be operated without risk of damage to components of the firearm.

The safety casing devices described herein are configured for use in a variety of firearms. For example, the safety casing can be used to safe a pistol or revolver of any caliber. The safety casing can also be used to safe a variety of long guns of any caliber including, but not limited to, single shot rifles, semi-automatic rifles, and bolt action rifles to name a few. Additionally, the safety casing can be used to safe a variety of shotguns of any gauge including, but not limited to, single shot shotguns, semi-automatic shotguns, pump-action shotguns. The safety casing of an embodiment is further used to safe other types of firearms not expressly listed herein (e.g., machine guns, etc.).

Figure 1:
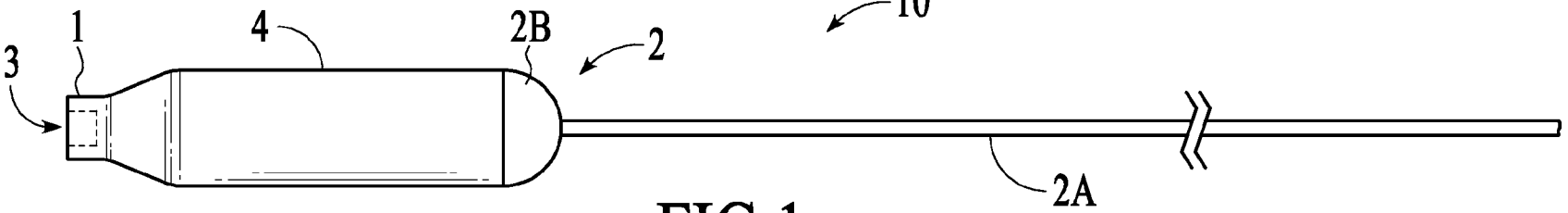
FIG. 1 shows a safety casing device for a firearm, under an embodiment.

FIG. 1 shows a safety casing device 10 for a firearm, under an embodiment. The safety casing device 10 can be of any caliber and any configuration appropriate to a host firearm, including pistols and/or long guns to name a few. The safety casing device 10 includes a metal casing 4. The metal casing 4 of an embodiment is a hollow casing of an ammunition round but is not so limited. The casing 4 can be formed as described below from a new casing or a used or spent casing. A front portion or region of the casing includes an open end (not shown). A rear portion or region of the casing tapers to form a base 1.

The area of a cross-section of the base 1 of an embodiment is smaller than an area of a cross-section of the area of the rear or front portions of the casing 4. The base 1 is formed, for example, by removing (e.g., via machining) the rim portion of the base 1 of a conventional new or used metal casing as described below. The base 1 of an embodiment includes an aperture 3 or recessed region that is configured to receive a firing pin of a firearm without making substantial contact with the firing pin. The recessed region 3, for example, is formed by the absence of a primer or firing cap found in a conventional live ammunition round, but is not so limited.

Figure 2:
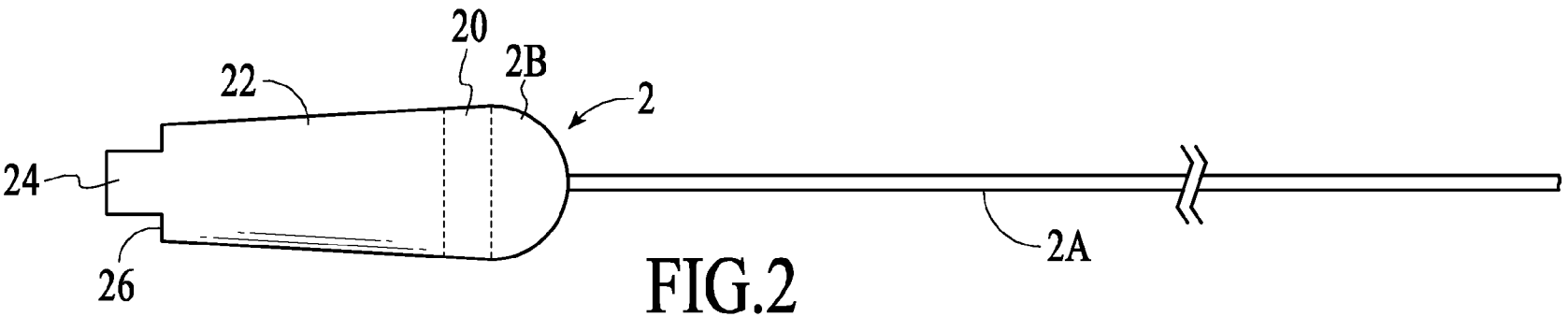
FIG. 2 shows a casing insert of a safety casing device, under an embodiment.

The open end of the front portion of the casing is configured to receive and contain a casing insert 2. FIG. 2 shows a casing insert 2 of a safety casing device 10, under an embodiment. The casing insert 2 is formed or configured to include an elongated indicator 2A or cord connected to a bullet-shaped end portion 2B. The casing insert 2 is formed from a semi-pliable material so as not to scratch, mar, or otherwise damage a host firearm during insertion, removal and/or use in the firearm. The semi-pliable material includes, for example, any number of plastics or polymers but is not so limited.

The indicator 2A of an embodiment has a round cross-sectional geometry. Alternatively, the indicator 2A can have a cross-sectional geometry of any shape (e.g., square, rectangular, triangular, hexagonal, octagonal, etc.) as appropriate to a barrel configuration of the weapon in which it is intended for use.

The indicator 2A of an embodiment has a fluorescent hue or color to make the indicator 2A easy to see when in and protruding from the barrel of a host firearm. The indicator 2A hue or color is such that the indicator 2A is highly visible. Alternatively, the indicator 2A can be formed from a material that causes it to be visible in low light or no-light conditions (e.g., visible at night). The length of the indicator 2A varies according to the firearm in which the safety casing device 10 is being used. For example, the length of the indicator 2A can be trimmed so as to protrude beyond the end of the barrel of the host firearm far enough to be easily recognized by the user and bystanders. Therefore, a user can insert the safety casing device 10 into the firearm chamber, close the chamber, and trim or adjust the length of the indicator 2A to be appropriate to the firearm (e.g., trim so as to protrude four (4) inches beyond the end of the barrel).

Figure 1A:
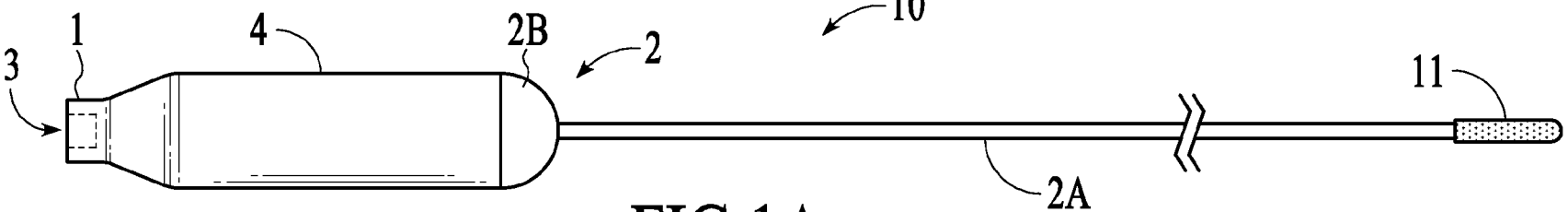
FIG. 1A is a safety casing device 10 including a cap 11, under an embodiment.

FIG. 1A is a safety casing device 10 including a cap 11, under an embodiment. In this configuration, the indicator 2A of an embodiment includes a cap 11 on a distal end. The cap is formed from a semi-pliable material so as not to scratch, mar, or otherwise damage a host firearm during insertion, removal and/or use in the firearm. The semi-pliable material includes, for example, any number of plastics or polymers but is not so limited. The cap 11 of an embodiment has a round cross-sectional geometry. Alternatively, the cap 11 can have a cross-sectional geometry of any shape (e.g., square, rectangular, triangular, hexagonal, octagonal, etc.) as appropriate to a barrel configuration of the weapon in which it is intended for use. The cap 11 is configured to be secured to the indicator 2A using, for example, one or more of glue, epoxy, shrink fitting, and/or mechanical pressing to name just a few.

In addition to the bullet-shaped end portion 2B, the casing insert 2 includes a press fitting portion 20, an angled or truncated cone-shaped portion 22, and a protrusion 24 set off by an annular ledge 26. The casing insert 2 is configured to be inserted directly into and secured by the casing 4. The casing insert 2 can have the protrusion 24 press fitted into the aperture 3 of the casing 4 and the surface 20 secured by the front portion of the metal casing 4 having been press fitted or crimped to the casing insert. The angled surface 22 allows the rapid insertion of the casing insert 2 to a point where the press fitting begins at both ends. The annular ledge 26 of the casing insert 2 is configured to stop the casing insert 2 from being inserted any further into the casing 4 by lodging itself against the inside of the base 1 as the protrusion 24 is inserted through the aperture 3. The safety casing device 10 thereby has the casing insert 2 press fitted at both ends of the casing 4.

The safety casing device 10 is thus configured to allow the device 10 to be inserted into a chamber of any firearm such that, when positioned in the chamber, the firing pin of the firearm will strike against the end of the protrusion 24 protruding through the aperture 3 in the metal casing 4. Since there is no primer or firing cap in the safety casing device 10, the firearm will not fire and is thus safe for use during training exercises. Furthermore, the configuration of the safety casing device 10 is such that, when present in the chamber of a firearm, there is no rim or other material around or protruding radially from the base that can damage components (e.g., firing pin, ejectors, etc.) of the firearm.

Additionally, the safety casing device is safe to insert and remove from the firearm without risking damage to the firearm. The risk of damage to the firearm is eliminated because, in contrast to conventional devices of this type, the safety casing device 10 does not include friction components (e.g., protrusions from the casing, protrusions from the casing insert, etc.) for securing the device in the firearm. Instead, the safety casing device 10 is formed using a metal casing having a form factor of actual ammunition configured for the same firearm, so that foreign objects are not required in removal of the safety casing device 10 from a firearm. Removal of the safety casing device 10 is effected by opening the chamber of firearm and pushing slightly on the portion of the indicator 2A protruding from the barrel end.

The process of making a safety casing device includes selecting a new or used metal casing 4 having a base 1 and an open end (not shown). The casing 4 is prepared by removing (e.g., machining away) the rim of the casing 4 and forming an aperture 3 in the base 1 of the casing 4. Formation of the aperture 3 can be by drilling, punching, and/or any other known cutting technique. The casing insert 2 is generated by, for example, forming a polymer insert member having a bullet-shaped end 2B and an annular press fitted area 20 along with a truncated cone or angled area 22 proceeding down to an annular ledge 26 where a sized protrusion 24 is formed on the end of the polymer insert member 2. The forming can be by injection molding, machining, or any other technique desired and using any polymer desired, such as polyethylene or ABS. The indicator 2A can be formed as an integral part of the insert 4 or, alternatively, as a separate component that is later affixed to the bullet-shaped end 2B. The casing insert 2 is placed in the metal casing 4 and the front portion of the casing 4 is press fitted or crimped to secure the casing insert 2 and thus form the safety casing device 10 having the bullet-shaped end 2B and protruding indicator 2A.

In addition to use during firearm training exercises, the safety casing device of an embodiment can be used to indicate the safe condition of a firearm during transportation and storage of the host firearm. When used during transportation and storage, the safety casing device of an embodiment provides moisture control in the firearm environment.

FIG. 3 is a safety casing device 100 configured for moisture control, under an alternative embodiment. The safety casing device 100 can be of any caliber and any configuration appropriate to pistols and/or long guns to name a few. The safety casing device 100 includes a metal casing 104. The metal casing 104 of an embodiment is a hollow casing of an ammunition round but is not so limited. The casing 104 can be formed from a new casing or a used or spent casing. A front portion or region of the casing includes an open end (not shown). A rear portion or region of the casing tapers to form a base 101. The area of a cross-section of the base 101 is smaller than an area of a cross-section of the area of the rear or front portions of the casing 104. The base 101 is formed, for example, by removing (e.g., via machining) the rim portion of the base of a conventional new or used metal casing.

The base 101 of an embodiment includes an aperture 103 or recessed region that is configured to receive a firing pin of a firearm without making substantial contact with the firing pin. The recessed region 103, for example, is formed by the absence of a primer or firing cap found in a conventional live ammunition round, but is not so limited.

The safety casing device 100 is configured to wick moisture from the environment of the host firearm and in so doing provides moisture control. Thus, the safety casing device 100 of an embodiment includes vents 112-114 in one or more regions of the device 100. The safety casing device 100 of an embodiment includes vents 114 in the casing 104. The safety casing device 100 of an alternative embodiment includes vents 112 in the casing insert 102. The safety casing device 100 of another alternative embodiment includes vents 113 in the recessed region 103 of the base 101. In yet another example embodiment, the safety casing device 100 can include vents 114 in the casing 104, vents 112 in the casing insert 102, and/or vents 113 in the recessed region 103 of the base 101. The vents of an embodiment are formed using holes and/or slits but are not so limited.

In addition to the vents, at least a portion of the casing 104 and/or casing insert 102 is configured to include a moisture absorbing agent or composition (not shown). The safety casing device 100 of an embodiment includes a silica composition inside the casing 104 and/or the casing insert 102 as a moisture absorbing agent but is not so limited. The vents in one or more regions of the device allow the silica to absorb or wick moisture from the environment of the host firearm. The environment of the firearm includes the environment inside the firearm (e.g., chamber, barrel, etc.) as well as the external environment in proximity of the firearm.

The safety casing device 100 of an embodiment can also include a locking device 106 for further securing the safety casing device in the firearm. In an embodiment, a barrel cord lock 106 is secured to the indicator 2A following insertion of the safety casing device 100 in the host firearm. The barrel cord lock 106 functions to further secure the safety casing device in the firearm chamber. Furthermore, the barrel cord lock 106 is formed to have a fluorescent hue or color to make the indicator with the barrel cord lock easier to see than the indicator alone.

FIG. 3A is a locking device 306, under an alternative embodiment. The locking device 306 includes a through hole 306H or orifice configured to accept or allow the locking device 306 to be slipped over a distal end of the indicator 2A. When the locking device 306 is positioned to secure the safety casing 10 in the firearm, the locking device 306 includes a distal portion 306D configured to remain outside the barrel 301 of the host firearm, and a proximal portion 306P that is a protrusion sized and/or configured to be partially positioned in the distal end of the barrel 301. The protrusion 306P is configured to stabilize the locking device 306 in the barrel 301. The locking device 306 includes a removable securing device 306S (e.g., plug, set screw, clip, etc.) configured for secure contact with or against the indicator 2A when the securing device 306S is inserted through an orifice 306T in the locking device.

The protrusion 306P described herein is configured for use in one of a variety of firearms. For example, the protrusion 306P can be configured for various models and calibers of pistol or revolver. The protrusion 306P can also be configured for various models and calibers of long guns including, but not limited to, single shot rifles, semi-automatic rifles, and bolt action rifles to name a few. Additionally, the protrusion 306P can be configured for various models and calibers of shotguns including, but not limited to, single shot shotguns, semi-automatic shotguns, pump-action shotguns. The protrusion 306P can be configured for various models and calibers of other types of firearms not expressly listed herein (e.g., machine guns, etc.).

The locking device 306 is formed from a semi-pliable material so as not to scratch, mar, or otherwise damage a host firearm during use with the firearm. The semi-pliable material includes, for example, any number of plastics or polymers but is not so limited. The locking device 306 hue or color is such that the locking device 306 is highly visible. Alternatively, the locking device 306 can be formed from a material that causes it to be visible in low light or no-light conditions (e.g., visible at night).

FIG. 4 shows a firearm 400 with a safety casing device 100 in the chamber, under an embodiment. The firearm 400 shown represents a semi-automatic handgun, but the safety casing device 100 can be of any caliber and any configuration appropriate to any size or caliber of handgun and/or long gun. The safety casing device 100 in the firearm 400 of this example is configured for moisture control, but a safety casing device 10 (FIG. 1) without moisture control can also be used as appropriate.

The indicator 2A of an embodiment, as described above, has a fluorescent hue to make the indicator easy to see when in the firearm. The length of the indicator 2A is configured by the user according to the firearm 400 in which the safety casing device 100 is being used. For example, the length of the indicator 2A can be trimmed so as to protrude beyond the end of the barrel enough to be easily recognized by the user and bystanders. Therefore, a user can insert the safety casing device 100 into the firearm chamber, close the chamber, and trim or adjust the length of the indicator 2A to be appropriate to the firearm (e.g., trim so as to protrude one (1) inch beyond the end of the barrel).

The safety casing device 100 of an embodiment includes a device 106 for further securing the safety casing device in the firearm. In an embodiment, a barrel cord lock 106 is secured to the indicator 2A following insertion of the safety casing device 100 in the host firearm 400. The barrel cord lock 106 functions to further secure the safety casing device in the firearm chamber. Furthermore, like the indicator, the barrel cord lock 106 also has a fluorescent hue or color to make the indicator with the barrel cord lock easier to see than the indicator alone.

The safety casing device 100, as described above, is configured to allow the device 100 to be inserted into the chamber of the firearm such that, when positioned in the chamber of the firearm, the base of an embodiment includes an aperture that is configured to receive the firing pin of the firearm without making substantial contact with the firing pin. Therefore, the firing pin will strike against the end of the protrusion of the casing insert protruding through the aperture in the metal casing instead of striking against a surface of the device 100. Since there is no primer or firing cap in the safety casing device 100, the firearm will not fire and is thus safe for use during training exercises. This configuration prevents the firing pin from making contact with the device 100 and prevents the chance for damage to the firing pin. Furthermore, the configuration of the safety casing device 100 is such that, when present in the chamber of a firearm, there is no rim or other material around or protruding radially from the base that can damage the firearm ejectors 402.

The safety casing device 100 is configured to wick moisture from the environment of the host firearm 400 and in so doing provides moisture control. The safety casing device 100 of an embodiment includes vents in one or more regions of the device 100. For example, the safety casing device 100 can include vents in the casing 104, the casing insert 102, and/or the recessed region 103 of the base 101. The casing and casing insert includes a moisture absorbing agent 405, and the vents in one or more regions of the device allow the moisture absorbing agent 405 to absorb or wick moisture from the environment of the host firearm 400.

Aspects of the safety casing devices described herein may be implemented as a component of one or more other tactical systems or tactical equipment. Furthermore, the elements and acts of the various embodiments described above can be combined with one another and/or with other tactical components and equipment known in the tactical arena to provide further embodiments. These and other changes can be made to the safety casing devices in light of the above detailed description.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

The above description of illustrated embodiments of the safety casing devices is not intended to be exhaustive or to limit the safety casing devices to the precise form disclosed. While specific embodiments of, and examples for, the safety casing devices are described herein for illustrative purposes, various equivalent modifications are possible within the scope of the safety casing devices, as those skilled in the relevant art will recognize. The teachings of the safety casing devices provided herein can be applied to other tactical systems, not only for the systems and methods described above.

The elements and acts of the various embodiments described above can be combined to provide further embodiments. These and other changes can be made to the safety casing devices in light of the above detailed description.

In general, in the following claims, the terms used should not be construed to limit the safety casing devices to the specific embodiments disclosed in the specification and the claims, but should be construed to include all devices and methods under the claims. Accordingly, the safety casing devices are not limited by the disclosure, but instead the scope of the safety casing devices is to be determined entirely by the claims.

While certain aspects of the safety casing devices are presented below in certain claim forms, the inventor contemplates the various aspects of the safety casing devices in any number of claim forms. Accordingly, the inventor reserves the right to add additional claims after filing the application to pursue such additional claim forms for other aspects of the safety casing devices.

What is claimed is:

1. A firearm safety device, comprising:

a metal ammunition casing comprising a base devoid of a rim and a bullet aperture opposite the base, wherein the base of the metal ammunition casing comprises an orifice that receives a firing pin during dry firing of the firearm and prevents the firing pin from contacting the metal ammunition casing; and a casing insert comprising an indicator cord, wherein a front region of the casing insert is bullet-shaped and connected to the indicator cord, wherein the metal ammunition casing secures the casing insert through contact between an edge of the bullet aperture and the casing insert, wherein the indicator cord comprises a flexible material having a length such that a distal end of the indicator cord protrudes beyond a distal end of a barrel of a firearm having the firearm safety device positioned in a firearm chamber.

2. The firearm safety device of claim 1, comprising a color-coded cap fitted to the distal end of the indicator cord.

3. The firearm safety device of claim 1, comprising a locking device slideably coupled to the indicator cord, wherein the locking device secures the firearm safety device in a firearm chamber.

4. The firearm safety device of claim 1, wherein the metal ammunition casing includes vents in an exterior surface that vent an interior of the metal ammunition casing to an external environment, wherein the interior of the metal ammunition casing includes a moisture control agent that wicks moisture from the external environment.

5. The firearm safety device of claim 1, wherein the casing insert includes vents in an exterior surface that vent an interior of the casing insert to an external environment, wherein the interior of the casing insert includes a moisture control agent that wicks moisture from the external environment.

6. A firearm safety device, comprising:

a metal ammunition casing, the casing comprising a base with a primer aperture and a front portion with a bullet aperture, wherein the base is devoid of a rim;

a casing insert comprising a front end, a press fitting region, and a back end having a protrusion, wherein the front end is bullet-shaped, wherein the metal ammunition casing secures the casing insert in the bullet aperture through contact with the press fitting region of the casing insert, wherein the primer aperture receives the protrusion of the casing insert, wherein the protrusion of the casing insert comprises an orifice receiving a firing pin during dry firing of the firearm and preventing the firing pin from contacting the casing insert; and an indicator cord comprising a length of flexible material connected to the front end of the casing insert, wherein the length allows a distal end of the indicator cord to protrude beyond a distal end of a barrel of a firearm having the firearm safety device in a firearm chamber.

7. The firearm safety device of claim 6, comprising a color-coded cap fitted to the distal end of the indicator cord.

8. The firearm safety device of claim 6, comprising a locking device slideably coupled to indicator cord, wherein the locking device secures the firearm safety device in a firearm chamber.

9. The firearm safety device of claim 6, wherein the metal ammunition casing includes vents in an exterior surface that vent an interior of the metal ammunition casing to an external environment, wherein the interior of the metal ammunition casing includes a moisture control agent that wicks moisture from the external environment.

10. The firearm safety device of claim 6, wherein the casing insert includes vents in an exterior surface that vent an interior of the casing insert to an external environment, wherein the interior of the casing insert includes a moisture control agent that wicks moisture from the external environment.

11. The firearm safety device of claim 6, wherein the casing insert comprises a semi-pliable material.

12. A method comprising:

forming a metal ammunition casing comprising a base devoid of a rim and a bullet aperture opposite the base, wherein forming the metal ammunition casing comprises forming an orifice in the base that receives a firing pin during dry firing of the firearm and prevents the firing pin from contacting the metal ammunition casing;

forming a casing insert with an indicator cord, wherein the forming includes forming a front region of the casing insert to have a bullet shape and to connect to the indicator cord, wherein the forming includes forming the indicator cord of a flexible material with a length such that a distal end of the indicator cord protrudes beyond a distal end of a barrel of a firearm having the firearm safety device positioned in a firearm chamber; and securing the casing insert in the metal ammunition casing by causing an edge of the bullet aperture to contact the casing insert.

13. The method of claim 12, comprising fitting a color-coded cap to the distal end of the indicator cord.

14. The method of claim 12, comprising slideably coupling a locking device to the indicator cord, wherein the locking device secures the firearm safety device in a firearm chamber.

15. The method of claim 12, wherein forming the metal ammunition casing comprises forming the metal ammunition casing to include vents in an exterior surface that vent an interior of the metal ammunition casing to an external environment, wherein the interior of the metal ammunition casing includes a moisture control agent that wicks moisture from the external environment.

16. The method of claim 12, wherein forming the casing insert comprises forming the casing insert to include vents in an exterior surface that vent an interior of the casing insert to an external environment, wherein the interior of the casing insert includes a moisture control agent that wicks moisture from the external environment.

* * * * *